US006161360A

United States Patent [19]

Smith

[11] Patent Number: 6,161,360

[45] Date of Patent: Dec. 19, 2000

[54] APPARATUS FOR SUPPORTING REINFORCEMENT BAR

[76] Inventor: Earl D. Smith, 1418 Duck Hunter Ct., Virginia Beach, Va. 23451

[21] Appl. No.: 09/315,932

[22] Filed: May 20, 1999

[51] Int. Cl.[7] ..... E04C 5/16

[52] U.S. Cl. ..... 52/678; 52/165; 52/293.3; 52/295; 52/679; 52/686; 52/742.14

[58] Field of Search ..... 52/165, 293.3, 52/295, 678, 679, 686, 742.14

[56] References Cited

U.S. PATENT DOCUMENTS

| | | | |
|---|---|---|---|
| 1,852,673 | 4/1932 | Pilj | 52/679 X |
| 1,986,528 | 1/1935 | Ranger . | |
| 2,772,560 | 12/1956 | Neptune . | |
| 4,692,052 | 9/1987 | Yee . | |
| 5,134,828 | 8/1992 | Baur . | |
| 5,371,991 | 12/1994 | Bechtel et al. | 52/686 |
| 5,456,051 | 10/1995 | Queen et al. . | |
| 5,688,428 | 11/1997 | Maguire . | |

*Primary Examiner*—Christopher T. Kent
*Attorney, Agent, or Firm*—MacMillan, Sobanski & Todd, LLC

[57] ABSTRACT

An apparatus for supporting reinforcement bar comprises a support assembly including a first support and a second support. The first support has a ground-engaging portion. The second support is coupled to the first support so that the ground-engaging portion provides subjacent support for the second support. The second support is structured and dimensioned to support a reinforcement bar in a substantially upright position. A support member is coupled to the support assembly. The support member is provided for vertically supporting another reinforcement bar. A method for supporting reinforcement bar comprises the steps of providing a ditch having a bottom surface and apparatus for supporting reinforcement bar. The method next comprises the step of positioning apparatus for supporting reinforcement bar in the ditch with an end of apparatus protruding from the ditch and a ground-penetrating portion driven in the bottom surface of the ditch. The method further comprises the step of coupling substantially horizontal reinforcement bars to support members of the apparatus. Upon completion of the foregoing steps, the method comprises the steps and of filling the ditch with suitable pour material so that the end of the apparatus protruding from the ditch remains exposed and allowing the concrete to harden. Once the concrete has hardened, a wall may be formed on the hardened concrete. The method comprises the final step of inserting substantially upright reinforcement bars into the apparatus.

30 Claims, 7 Drawing Sheets

APPARATUS FOR SUPPORTING REINFORCEMENT BAR

BACKGROUND

Commercial buildings are predominantly masonry, a construction of stone or similar materials such as concrete or brick. A portion of the building structure that transmits the building load to the ground is referred to as a foundation. Foundations are typically reinforced with reinforcement bars, commonly referred to as rebars. Walls are generally constructed of block having cells filled with grout and reinforced with reinforcement bar. The walls are built upon a supporting base or underlying structure referred to as a footing or footer. Footings, like foundations and walls, are typically reinforced with reinforcement bar.

Construction of commercial buildings generally begins with the formation of the footings. The footings are typically formed by arranging an array of horizontal and vertical reinforcement bars in a ditch. The ditch is subsequently filled with grout. The grout is allowed to harden to form a solid structure. The horizontal reinforcement bars reinforce the footings along a horizontal axis. The vertical reinforcement bars protrude from the footings at horizontally spaced intervals to reinforce the walls.

The vertical reinforcement bars typically extend five feet or more above the footings. In constructing walls, blocks have to be raised above the vertical reinforcement bars and lowered to the footing with the reinforcement bars extending through hollow block cells. Layers of block are laid upon one another following the same method of raising blocks above the reinforcement bars and lowering the blocks to a subsequent layer of block with the reinforcement bars extending through various hollow block cells. The blocks are typically joined to the footings and other blocks with grout. Each layer of block is commonly referred to as a course.

Once so many courses of block have been laid, and while a desired length of each spaced apart vertical reinforcement bar remains exposed beyond the block wall being formed, another length of vertical reinforcement bar is tied to the exposed portion of each existing vertical reinforcement bar. This method is continued until a wall of desired height is achieved. Once a wall of desired height is achieved, the hollow block cells are filled with grout to form a cement masonry unit (CMU).

Present methods for supporting reinforcement bar include the cumbersome method of cutting numerous pieces of wood. The pieces of wood are tightly inserted in a ditch within which a footing is to be formed. A separate piece of wood is required to straddle the top and bottom of the ditch. Reinforcement bars are tied to the pieces ofwood with tie wire. An apparatus for supporting reinforcement bar and for effecting rise to a less cumbersome method for supporting reinforcement bar is needed.

SUMMARY

The invention is directed to a reinforcement bar support apparatus that satisfies the foregoing as well as other needs. An apparatus for supporting reinforcement bar comprises a support assembly including a first support and a second support. The first support has a ground-engaging portion. The second support is coupled to the first support so that the ground-engaging portion provides subjacent support for the second support. The second support is structured and dimensioned to support a reinforcement bar in a substantially upright position. A support member is coupled to the support assembly. The support member is provided for vertically supporting another reinforcement bar.

The invention is also directed to a method for supporting reinforcement bar. The method comprises the step of providing a ditch having a bottom surface and an apparatus for supporting reinforcement bar. The apparatus is positioned in the ditch with an end thereof protruding from the ditch and a ground-penetrating portion thereof driven into the bottom surface of the ditch. A substantially horizontal reinforcement bar is coupled to the support member. The ditch is then filled with grout so that the end of the apparatus protruding from the ditch remains exposed. The grout is then allowed to harden. After the grout has hardened, a substantially upright reinforcement bar may be inserted into the apparatus.

DESCRIPTION

Figure 1:
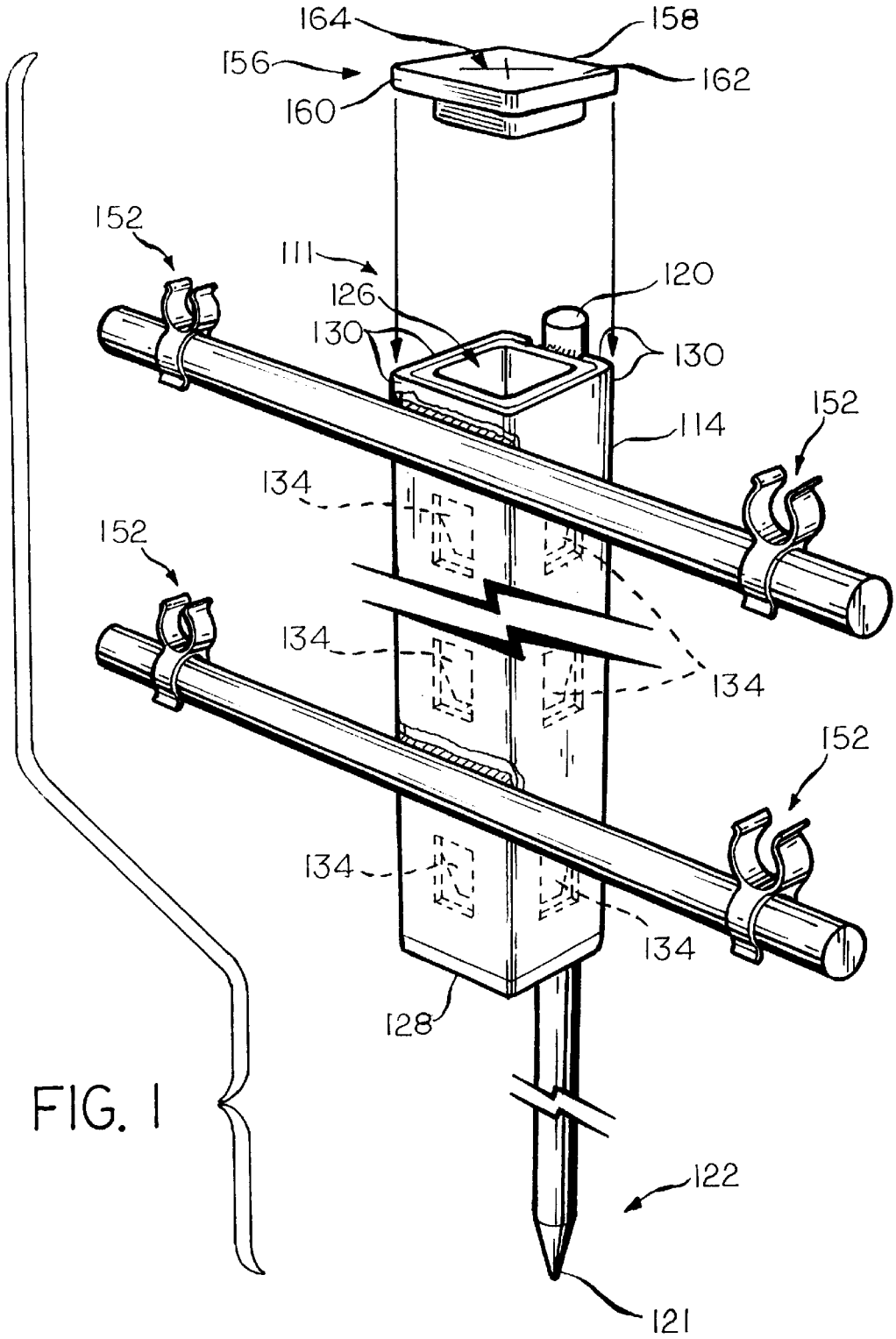
FIG. 1 is a partially exploded, partially broken front perspective view of an apparatus for supporting reinforcement bar.

Referring now to the drawings, there is illustrated in FIG. 1 an apparatus 110 for supporting reinforcement bar. The apparatus 110 comprises a support assembly 111. The support assembly 111 includes a first support 112 and a second support 114 coupled to the first support 112. The first support 112 and second support 114 may be any structure suitable of bearing the weight of an object or holding an object in position so as to keep the object from falling.

The first support 112 includes a ground-engaging portion 122. The groundpenetrating or engaging portion 122 is engageable with the ground G (shown in FIG. 6) to support the first support 112 relative to the ground G. The first support 112 is preferably supported in a substantially fixed position relative to the ground G.

The first support 112 preferably provides subjacent or underlying support for the second support 114. Most preferably, the ground-engaging portion 122 provides support beneath the second support 114 so as to maintain the second support 114 spaced above the ground G.

Figure 6:
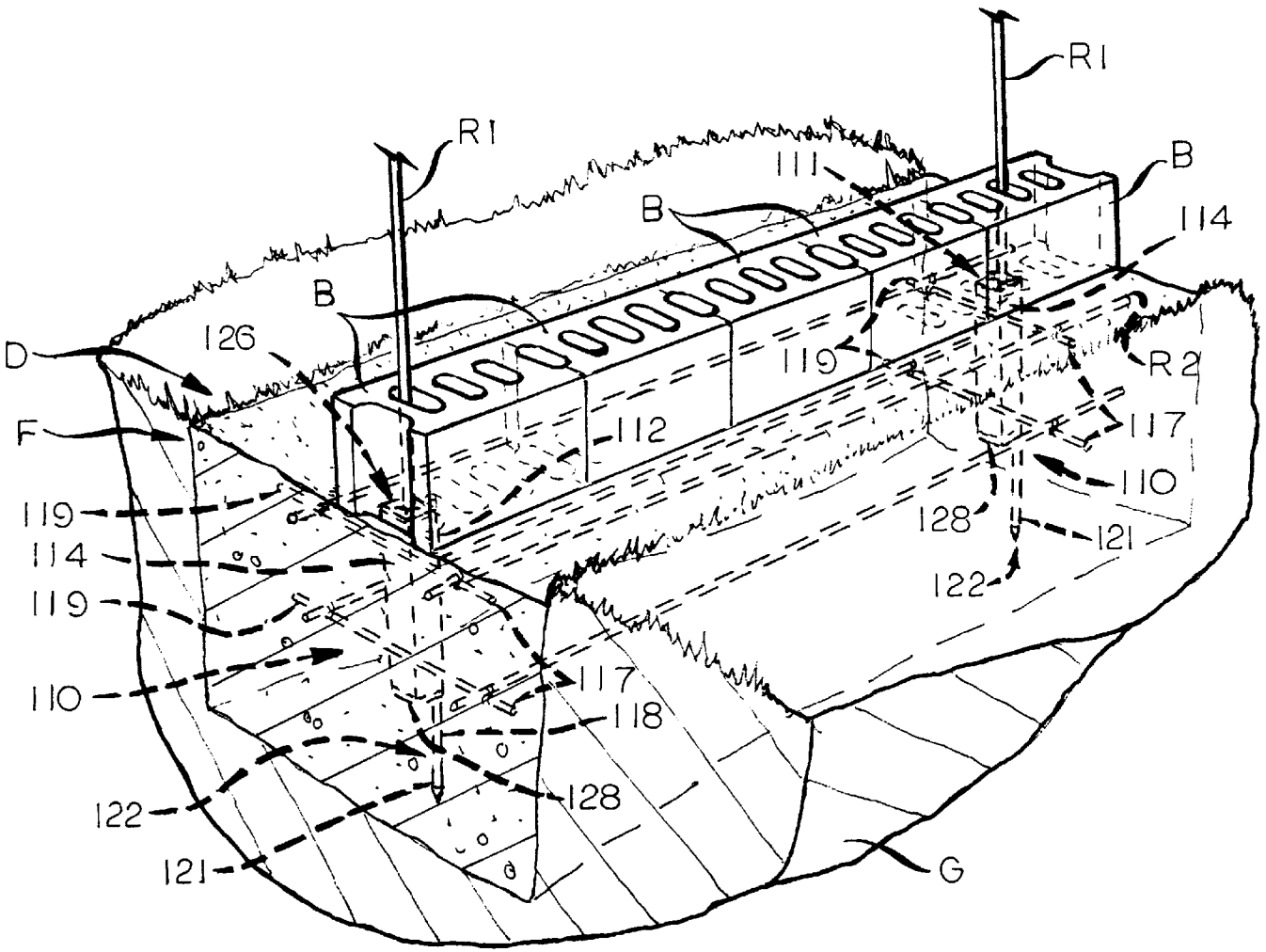
FIG. 6 is a reduced scale environmental front perspective view of a plurality of apparatus.
Figure 9:
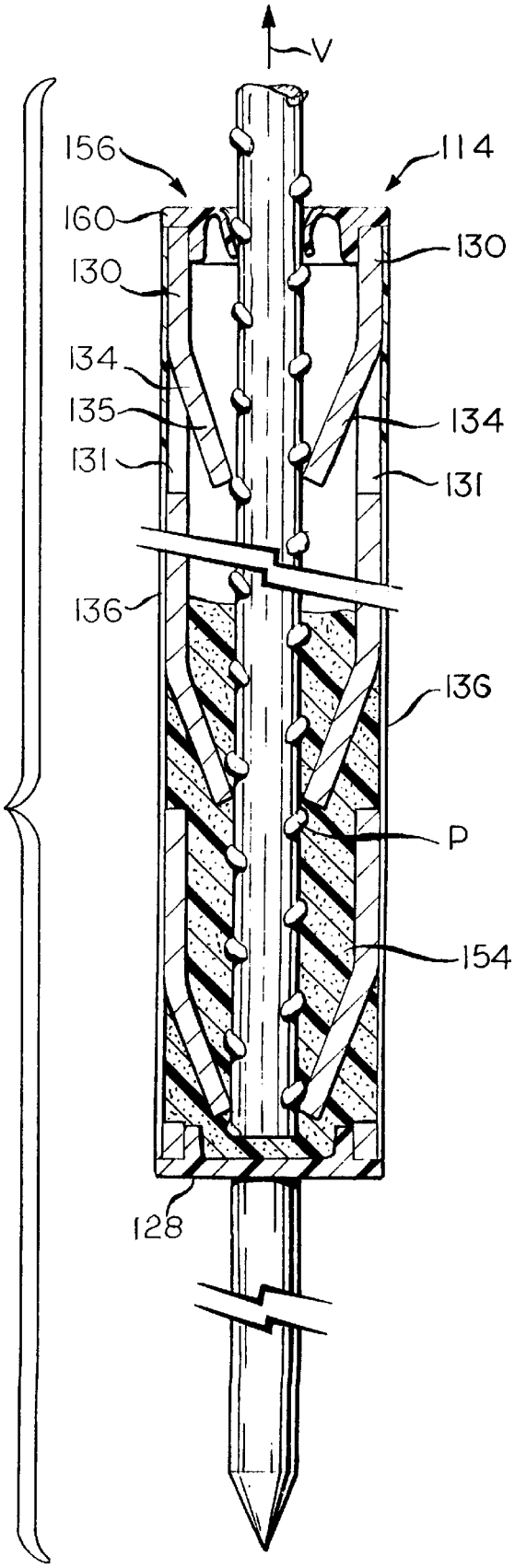
FIG. 9 is a cross-sectional view of the apparatus shown in FIG. 1.

The second support 114, in turn, is structured and dimensioned to support a reinforcement bar R1 (shown in FIGS. 6 and 9). The reinforcement bar R1 is preferably supported in a substantially upright position.

A support member 116 is coupled to the support assembly 111. The support member 116 is provided for vertically supporting another reinforcement bar or other reinforcement bars R2 (shown in FIGS. 4 and 6).

The first support 112 may be any structure suitable to provide upright support. For example, the first support 112 may be in the form of a post, pole, rod or stake.

The first support 112 preferably has opposite ends. A striking end or surface 120 may be provided at one of the ends and a piercing end or tip 121 may be provided at the other end. The ground-engaging portion 122 may be formed in part by the piercing tip 121. The piercing tip 121 is preferably a tip or point that is substantially sharp enough to pierce or penetrate the ground G (shown in FIG. 6).

The striking surface 120 is provided to receive a driving force, which is transmitted through the first support 112 to the piercing tip 121 to drive the piercing tip 121 into the ground G. The piercing tip 121, together with the ground-engaging portion 122, are preferably driven into the ground G at a depth sufficient to firmly support the second support 114 relative to the ground G.

The second support 114 may be in the form of a receiver or receptacle that is structured and dimensioned to receive a reinforcement bar R1 (shown in FIGS. 6 and 9) and to support the reinforcement bar R1 in a substantially upright position. The second support 114 is most preferably in the form of a sleeve having an opening or open end 126 and an abutment surface or a closed end 128 opposite the open end 126.

The open end 126 is provided for receiving a reinforcement bar R1 (shown in FIG. 9) into the second support 114. The closed end 128 is provided to function as a stop plate to prevent the reinforcement bar R1 from passing through the second support 114. The closed end 128 is provided to bear the weight of the reinforcement bar R1 and support the reinforcement bar R1 above or spaced from the ground G.

The second support 114 may have a rectangular cross-section formed by four sides 130. The four sides 130 define a void or chamber 132 (also shown in FIGS. 2 and 9). The chamber 132 is structured and dimensioned to receive a reinforcement bar R1 (shown in FIG. 6).

Figure 2:
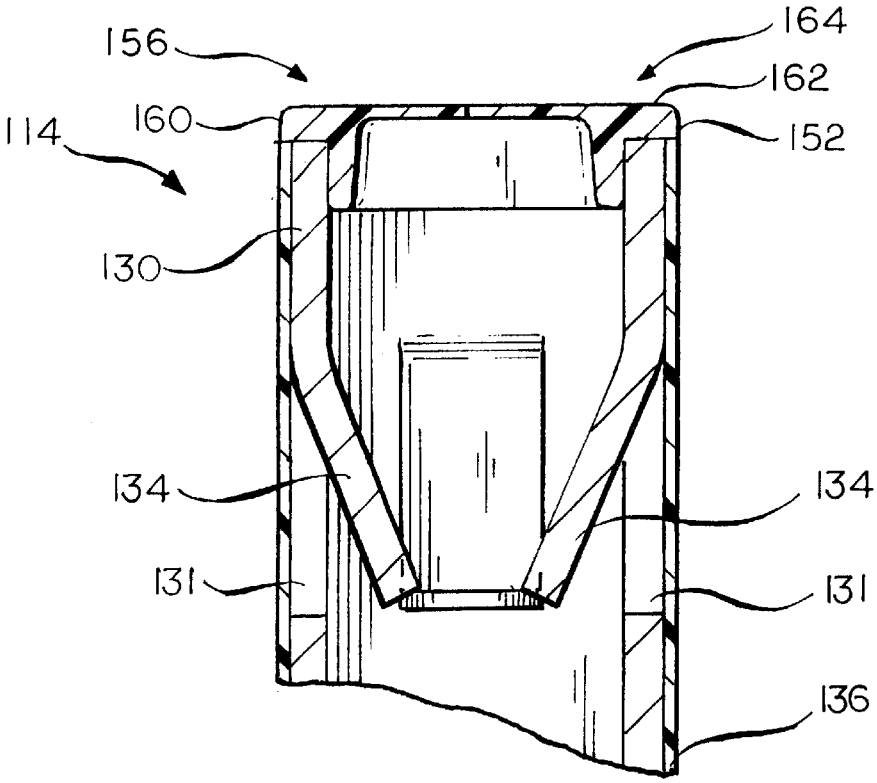
FIG. 2 is an enlarged partial cross-sectional view of a support of the apparatus shown in FIG. 1.

The second support 114 may support one or more interference members 134 (also shown in FIG. 2). The interference members 134 are most preferably supported within the chamber 132. The interference members 134 may be formed as an integral part of the sides 130. This may be accomplished by punching a plurality of tabs in the sides 130 and folding the tabs inwardly so as to form a plurality of opposing interference members 134.

The opposing interference members 134 described above would be resilient and thus displaceable to permit the passage of a reinforcement bar R1 (shown in FIGS. 6 and 9) into the chamber 132. Once a reinforcement bar R1 is inserted into the chamber 132, the interference members 134 cooperate to resist removal of the reinforcement bar R1 from the chamber 132. That is to say, the interference members 134 would offer resistance to movement of a reinforcement bar R1 in the direction of the arrow V (shown in FIG. 9).

It should be understood that the arrangement of interference members 134 shown and described above is provided for illustrative purposes. Other interference members may be suitable for carrying out the invention. However, it is preferable that interference members be provided to resist removal of a reinforcement bar R1 from the second support 114.

Punching tabs in the sides 130 of the second support 114 to form interference members 134 will produce openings 131 (also shown in FIG. 2) in the sides 130 of the second support 114. It may be desirable to cover the openings 131 with a cover 136 (also shown in FIGS. 2 and 8) to seal or enclose the chamber 132. Sealing the chamber 132 may be desirable to prevent grout or concrete C (shown in FIGS. 6 and 8) from entering into the chamber 132 through the openings 131.

It may also be desirable to seal the chamber 132 so as to contain filler 154 therein. For example, it may be desirable to fill the chamber 132 with filler 154 comprising a resin and a hardener which when mixed together harden to bond a reinforcement bar R1 in the chamber 132.

To further insure that the chamber 132 is sealed, the opening or open end 126 of the second support 114 may be blocked or covered with a penetrable cover 156 (also shown in FIGS. 2 and 9). The cover 156 may be in the form of a plug 158, such as a knockout plug. The plug 158 is principally defined a reduced dimension portion which is insertable in the opening or open end 126 of the second support 114.

A flange 160 may extend from the plug 158. The flange 160 may be provided to abut the open end 126 of the second support 114 to restrict the travel of the plug 158 into the open end 126.

A penetrable surface 162 is shown coplanar with the flange 160. The penetrable surface 162 is provided to block the open end 126 to prevent concrete from entering into the chamber 132 through the open end 126. The penetrable surface 162 may be formed from a substantially soft pliable material, which may be easily penetrated by a reinforcement bar R1 (shown in FIG. 9). The penetrable surface 162 may be cut or scored or perforated, as indicated at 164, so as to breakaway or form an opening therein upon impact with a reinforcement bar R1.

Figure 4:
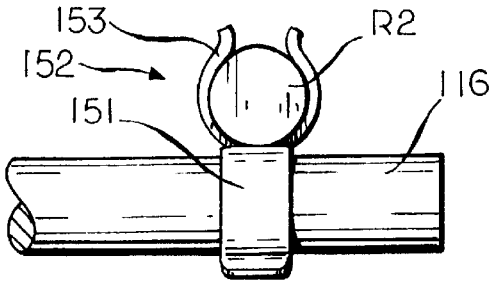
FIG. 4 is an enlarged partial front elevational view of a support member of the apparatus and a reinforcement bar coupled thereto with a clip.

As set forth above, at least one support member 116 is coupled to the support assembly 111 for vertically supporting one or more other reinforcement bars R2 (shown in FIGS. 4 and 6). The support member 116 is preferably coupled to the second support 114. Most preferably, a plurality of support members 116 are coupled to the second support 114. For example, at least two support members 116 are shown coupled to the second support 114. These support members 116 are in the form of transverse bars situated or lying across or crosswise relative to the second support 114.

Figure 3:
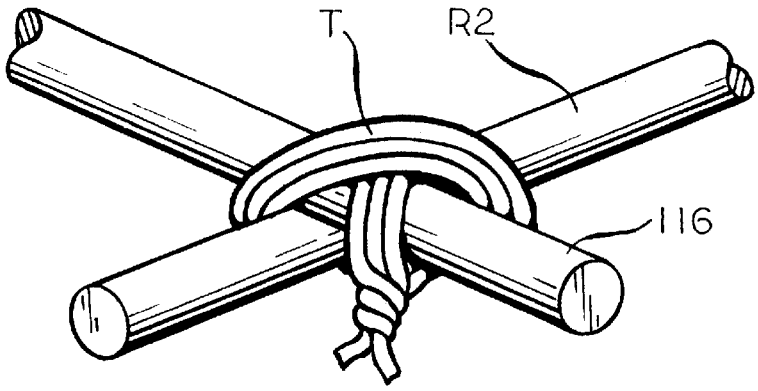
FIG. 3 is an enlarged partial front perspective view of a support member of the apparatus and a reinforcement bar coupled thereto with tie wire.

The support members 116 shown may provide subjacent support for substantially horizontally disposed reinforcement bar R2. Reinforcement bar R2 may be coupled to the support member 116 to hold the reinforcement bar R2 in a generally fixed position relative to the support member 116. The reinforcement bar R2 may be coupled to the support member 116 in any suitable manner. For example, reinforcement bar R2 may be coupled to the support member 116 with tie wire T (shown in FIG. 3).

It is preferred that the support member 116 support one or more clips 152 (shown in FIG. 4) structured and dimensioned to receive and hold the reinforcement bar R2 and thus secure the reinforcement bar R2 to the support member 116. A tandem clip 152' having two clip elements 151 and 153 may be suitable for carrying out the invention. One clip element 151 may be structured and dimensioned to receive and hold a portion of the support member 116. The other clip element 153 is structured and dimensioned to receive and releasably hold a plurality of reinforcement bars R2.

It is most preferred that each support member 116 have opposing ends 117 and 119 (shown in FIG. 6) and that each end 117 and 119 support one or more clips 152. In this way, an apparatus 110 according to the invention may provide vertical support for up to four substantially horizontal reinforcement bars R2 (also shown in FIG. 6).

Although it is preferred that the support members 116 provide subjacent support for the substantially horizontal reinforcement bars R2, the reinforcement bars R2 may be supported adjacent to or below the support members 116. For example, the ends 117 and 119 of the support members 116 may be provided with couplings (not shown) for securing reinforcement bars R2 to the ends 117 and 119 of the support member 116. Alternatively, reinforcement bars R2 may be coupled beneath the support member 116 (not shown) so as to support the reinforcement bars R2 from above.

Figure 5:
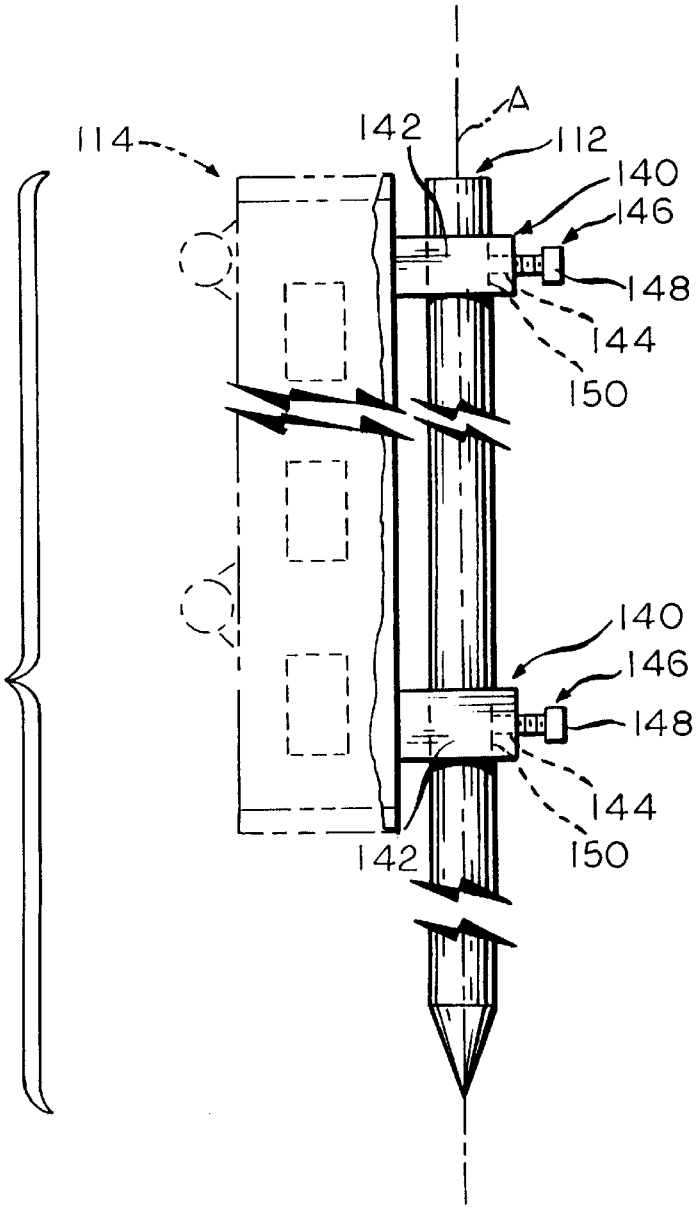
FIG. 5 is a partially broken side elevational view of the apparatus shown in FIG. 1.

The second support 114 may be rigidly attached to the first support 112, such as by welding the second support 114 to the first support 112. However, it may be desirable to adjust the position of the second support 114 relative to the first support 112, such as along the axis A (shown in FIG. 5) through the second support 114. This may be accomplished by coupling the second support 114 to the first support 112 by a movable coupling 140 (shown in FIG. 5) structured to permit the position of the second support 114 to be adjusted relative to the first support 112.

A movable coupling 140 may be in the form of a collar 142 attached to the second support 114 and engageable with the first support 112. The collar 142 may have a threaded hole 144 for receiving a threaded fastener 146, such as the hex cap screw shown.

Upon tightening the head 148 of the threaded fastener 146 in the threaded hole 144, the end 150 of the threaded fastener 146 opposite the head 148 frictionally engages the outer surface 124 of the first support 112. The threaded fastener 146 may be tightened sufficiently to hold the second support 114 in a substantially fixed position relative to the first support 112. The position of the second support 114 may be adjusted relative to the second support 114 by loosening the threaded fastener 146 to back the end 150 of the threaded fastener 146 away from the outer surface 124 of the first support 112.

It should be understood that the coupling 140 shown and described above is merely illustrative of a coupling that may be suitable for carrying out the invention and that the invention is not intended to be limited to the coupling 140 shown.

Figure 8:
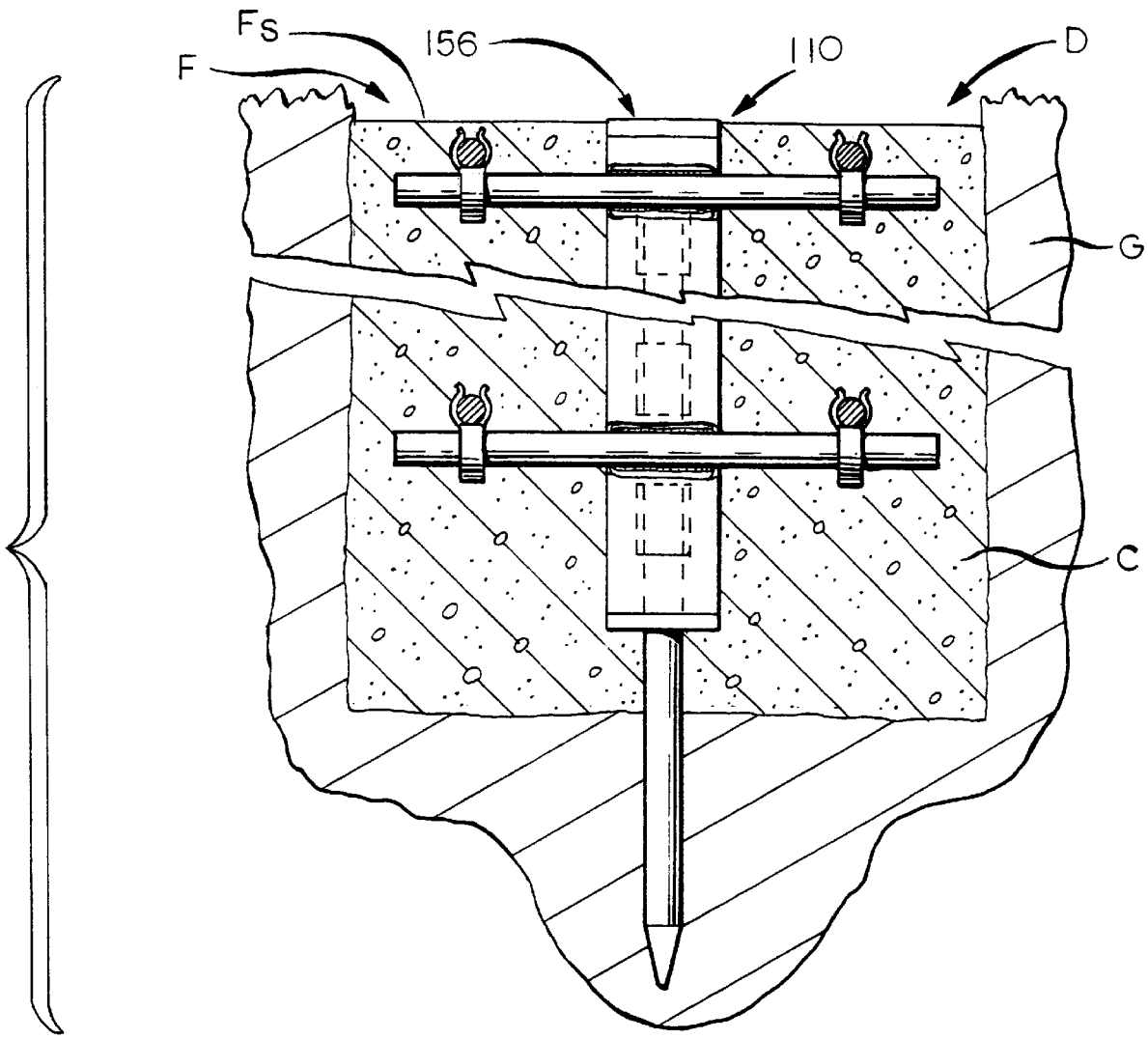
FIG. 8 is a reduced scale environmental front elevational view of the apparatus shown in FIG. 1.

In use, a plurality of apparatus 110 may be positioned in a ditch D, as shown in FIGS. 6 and 8. A plurality of apparatus 110 may be spaced so as to support upright reinforcement bar R1 according to building codes or standards. The apparatus 110 may also be spaced so as to provide vertical support for substantially horizontal reinforcement bars R2 extending between or bridging support members 116 (shown in FIG. 6) of adjacent apparatus 110.

Each apparatus 110 is supported in the ground G by driving the ground-engaging portion 122 (more clearly shown in FIG. 1) of each apparatus 110 into the bottom surface S of the ditch D. It is preferred that the open end 126 of the second support 114 or the cover 156 thereon protrude from the ditch D.

In addition to supporting the second support 114, the first support 112 may function as a grade stake used in preparing a footing surface $F_S$ of uniform slope. To prepare a footing surface $F_S$ of uniform slope, the ground-engaging portion 122 of the first support 112 may be driven into the ground G to a desired depth.

Once the apparatus 110 are positioned in the ditch as desired, reinforcement bars R2 may be extended across the support members 116 of the adjacent apparatus 110 so as to support the reinforcement bars R2 in a substantially horizontal position.

The substantially horizontal reinforcement bars R2 may be coupled to the support members 116 of the adjacent apparatus 110 in any suitable manner, such as by tying opposing ends of the reinforcement bar R2 to the ends 117 or 119 of the support members 116 of the adjacent apparatus 110.

Figure 7:
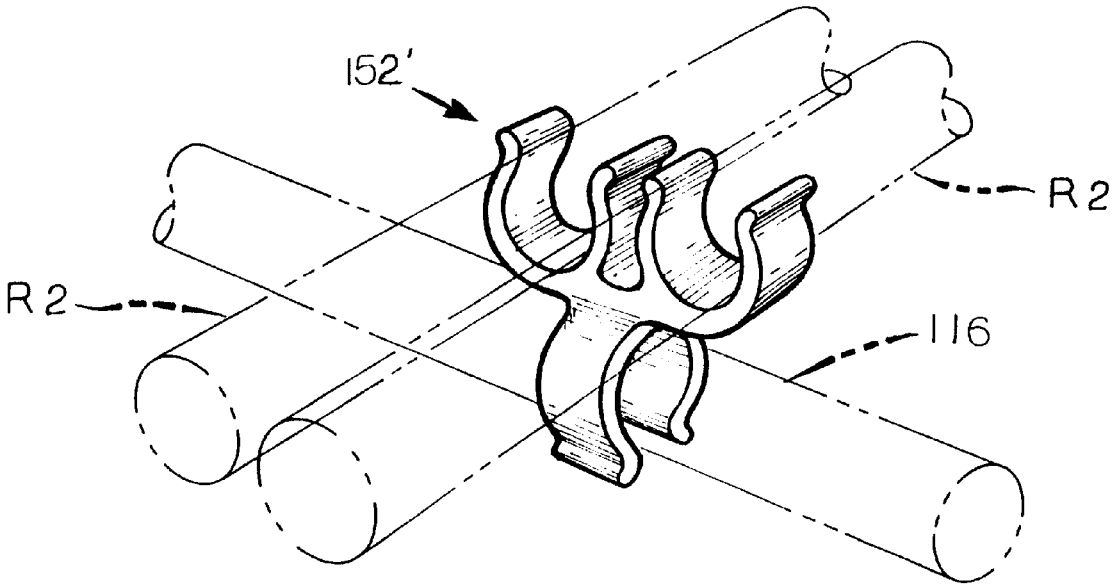
FIG. 7 is an enlarged front perspective view of an alternative clip for coupling two reinforcement bars and a support member together wherein the reinforcement bars and the support member are shown in broken line.

Alternatively, substantially horizontal reinforcement bars R2 may be coupled to the support member 116 of the adjacent apparatus 110 with couplings, such as the clip 152 described above. It may be necessary to provide two clips 152' (shown in FIG. 7) at the junction of two reinforcement bars R2 to secure both reinforcement bars R2 to a support member 116.

Once the apparatus 110 are in position and the substantially horizontal reinforcement bars are coupled to the support members 116, the ditch D may be filled with concrete C on any other suitable pour material. It is preferred that the open end 126 of the second support 114 of each apparatus 110 or the cover 156 thereon protrude or remain exposed from the concrete C.

A footing F is formed when the concrete C hardens. The substantially horizontal reinforcement bars R2 in the footing F reinforce the footing F along a horizontal axis.

A block wall W, as shown in FIG. 6, may be formed on the footing F. Hollow cell blocks B may be laid with the cells (shown but not referenced) arranged to be coaxial with one another. The coaxial cells may be arranged coaxially with the apparatus 110. After laying a predetermined course of block B, substantially upright reinforcement bars R1 may be inserted through the coaxial cells and further through the cover 156 into the second support 114, as shown in FIG. 9.

The travel of the substantially upright reinforcement bars R1 through the second support 114 is restricted by the closed end 128. The closed end 128 provides an abutment surface for the reinforcement bar R1 to prevent the reinforcement bar R1 from traveling any further and functions to vertically support the reinforcement bar R1 in an upright position.

The interference members 134 are deflected downward as the reinforcement bar R1 passes through the second support 114. The resilient nature of the interference members 134 causes the interference members 134 to bias inward towards the reinforcement bar R1.

Upon trying to remove or extract the reinforcement bar R1 from the second support 114, the interference members 134 tend to engage ribs or protrusions P protruding from the reinforcement bar R2. The interaction between the interference members 134 and the protrusions P of the reinforcement bar R1 resists removal of the reinforcement bar R1 from the second support 114, or movement of the reinforcement bar R1 in the direction of arrow V.

Once reinforcement bars R1 are placed in the second support 114 of each apparatus 110, the block cells C may be filled with any concrete C or any other suitable pour material. The concrete C and reinforcement bars R1 reinforce the walls W and thus improve the structural integrity of the walls W.

An apparatus 110 according to the invention may be made of any suitable material. It is preferable that the first support 112 and support member 116 be formed of metal. The ground-engaging portion 122 of the first support 112 is preferably formed of a hardened rust-resistant material, such as plastic, or a metal coated with a water insoluble coating 118. It is most preferable that any portion of the apparatus 110 which may contact the soil or ground G, such as the ground-engaging portion 122, be a rust-resistant material or metal coated with a water insoluble coating 118. Any portion of the apparatus 110 prone to rust that is exposed to the ground G may rust. The rust may penetrate the hardened concrete C and expand, causing the concrete C to split or crack, compromising the integrity of the footing F.

A method 210 for supporting reinforcement bar may be summarized with reference to FIG. 11. The method comprises the steps 212 and 214 of providing a ditch having a bottom surface and apparatus for supporting reinforcement bar. The method 210 next comprises the step 216 of positioning the apparatus for supporting reinforcement bar in the ditch with an end of the apparatus protruding from the ditch and a ground-penetrating portion driven in the bottom surface of the ditch. The method further comprises the step 218 of coupling substantially horizontal reinforcement bars to support members of the apparatus.

Upon completion of the foregoing steps, the method 210 comprises the steps 220 and 222 of filling the ditch with suitable pour material so that the end of the apparatus protruding from the ditch remains exposed and allowing the concrete to harden.

Once the concrete has hardened, a wall may be formed on the hardened concrete. The method comprises the final step 224 of inserting substantially upright reinforcement bars into the apparatus.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An apparatus for supporting reinforcement bar, comprising:

a support assembly including:

a first support having a ground engaging portion; and a second support coupled to the first support so that the ground engaging portion provides subjacent support for the second support, the second support being structured and dimensioned to support a reinforcement bar in a substantially upright position, the second support further including an opening for receiving the reinforcement bar therein and a penetrable cover blocking the opening; and a lateral support member coupled to the support assembly for vertically supporting another reinforcement bar.

2. The apparatus of claim 1, wherein the support assembly and the lateral support member are hard plastic.

3. The apparatus of claim 1, wherein the support assembly and the lateral support member are metal coated with a water insoluble coating.

4. The apparatus of claim 1, wherein the second support is coupled to the first support by a coupling structure to permit the position of the second support to be adjusted relative to the first support.

5. The apparatus of claim 1, further comprising at least one clip supported by the lateral support member, the clip being structured and dimensioned to receive and hold the reinforcement bar supported by the lateral support member.

6. The apparatus of claim 1, further comprising filler for filling the second support to secure the reinforcement bar therein.

7. The apparatus of claim 1, wherein the cover includes a plug having a portion that is insertable in the opening of the second support and a penetrable surface covering the opening.

8. The apparatus of claim 6, wherein the filler is comprised of a resin and a hardener.

9. An apparatus for supporting reinforcement bar, comprising:

a support assembly including:

a standard having a ground penetrating portion; and a receiver coupled to the standard for receiving a reinforcement bar and supporting the reinforcement bar in a substantially upright position, the receiver including an opening for receiving the reinforcement bar therein and a penetrable cover blocking the opening; and at least one lateral support member coupled to the support assembly for vertically supporting another reinforcement bar.

10. The apparatus of claim 9, wherein the support assembly and the lateral support member are hard plastic.

11. The apparatus of claim 9, wherein the support assembly and the lateral support member are metal coated with a water insoluble coating.

12. The apparatus of claim 9, wherein the receiver is coupled to the standard by a coupling structured to permit the position of the receiver to be adjusted relative to the standard.

13. The apparatus of claim 9, further comprising at least one clip supported by the lateral support member, the clip being structured and dimensioned to receive and hold the reinforcement bar supported by the lateral support member.

14. The apparatus of claim 9, further comprising filler for filling the receiver to secure the reinforcement bar there, wherein the filler includes a resin and a hardener.

15. The apparatus of claim 9, wherein the cover includes a plug having a portion that is insertable in the opening of the receiver and a penetrable surface covering the opening.

16. The apparatus of claim 14, wherein the filler is comprised of a resin and a hardener.

17. An apparatus for supporting reinforcement bar, comprising:

a stake having opposite ends with a striking surface at one end and a piercing tip at the other end;

a sleeve coupled to the stake, the sleeve defining a chamber and having an open end and a closed end opposite the open end, the sleeve supporting at least one interference member in the chamber;

a cover blocking the open end; and at least two vertically spaced transverse bars coupled to the sleeve.

18. The apparatus of claim 17, wherein the stake, sleeve and transverse bars are hard plastic.

19. The apparatus of claim 17, wherein the stake, sleeve and transverse bars are plastic-coated metal.

20. The apparatus of claim 17, wherein the sleeve is coupled to the stake by at least one collar attached to the sleeve and engageable with the stake, the collar having a threaded hole for receiving a threaded fastener that is engageable with the stake to releasably coupled the sleeve to the stake.

21. The apparatus of claim 17, further comprising at least one clip supported by each end of each transverse bar, the clip being structured and dimensioned to receive and hold a reinforcement bar.

22. The apparatus of claim 17, further comprising filler for filling the sleeve to secure a reinforcement bar therein, wherein the filler includes a resin and a hardener.

23. The apparatus of claim 17, wherein the cover includes:

a plug having a portion that is insertable in the open end of the sleeve;

a flange that abuts the end of the sleeve about the open end; and a penetrable surface covering the open end.

24. The apparatus of claim 17, wherein the sleeve has a rectangular cross-section defined by four sides each having a plurality of tabs punched therein and folded inward of the sleeve so as to form a plurality of opposing interference members that cooperatively resist removal of a reinforcement bar from the sleeve.

25. A method for supporting reinforcement bar, comprising the steps of:

(a) providing a ditch having a bottom surface;

(b) providing a reinforcement bar support apparatus comprising:

a support assembly having a ground penetrating portion coupled thereto; and at least one lateral support member coupled to the support assembly; and (c) positioning the apparatus in the ditch with an end thereof protruding from the ditch and the ground penetrating portion driven into the bottom surface of the ditch.

26. The method of claim 25, further comprising the step of:

(d) coupling a substantially horizontal reinforcement bar to the lateral support member.

27. The method of claim 26, further comprising the steps of:

(e) filling the ditch with pour material so that the end of the apparatus protruding from the ditch remains exposed; and (f) allowing the pour material to harden.

28. The method of claim 27, further comprising the step of:

(g) inserting a substantially upright reinforcement bar into the apparatus.

29. An apparatus for supporting reinforcement bar, comprising:

a support assembly including:

a first support having a ground engaging portion; and a second support coupled to the first support so that the ground engaging portion provides subjacent support for the second support, the second support being structured and dimensioned to support a reinforcement bar in a substantially upright position, the second support further being coupled to the first support by a coupling structured to permit the position of the second support to be adjusted relative to the first support; and a lateral support member coupled to the support assembly for vertically supporting another reinforcement bar.

30. An apparatus for supporting reinforcement bar, comprising:

a support assembly including:

a standard having a ground penetrating portion; and a receiver coupled to the standard for receiving a reinforcement bar and supporting the reinforcement bar in a substantially upright position, the receiver being coupled to the standard by a coupling structured to permit the position of the receiver to be adjusted relative to the standard; and at least one lateral support member coupled to the support assembly for vertically supporting another reinforcement bar.

* * * * *